US008465275B2

(12) United States Patent
Vonzell

(10) Patent No.: US 8,465,275 B2
(45) Date of Patent: Jun. 18, 2013

(54) CANDLEHOLDER AND METHOD

(76) Inventor: Suzetta Vonzell, Auburn, CA (US)

( * ) Notice: Subject to any disclaimer, the term of this patent is extended or adjusted under 35 U.S.C. 154(b) by 501 days.

(21) Appl. No.: 12/734,056

(22) PCT Filed: Oct. 9, 2008

(86) PCT No.: PCT/US2008/079259

§ 371 (c)(1),
(2), (4) Date: Apr. 7, 2010

(87) PCT Pub. No.: WO2009/048992

PCT Pub. Date: Apr. 16, 2009

(65) Prior Publication Data

US 2010/0209861 A1 Aug. 19, 2010

Related U.S. Application Data

(60) Provisional application No. 60/998,145, filed on Oct. 9, 2007, provisional application No. 61/011,762, filed on Jan. 22, 2008.

(51) Int. Cl.

| | |
|---|---|
| ***F21V 35/00*** | (2006.01) |
| ***F23D 3/16*** | (2006.01) |
| ***B21D 39/03*** | (2006.01) |

(52) U.S. Cl.
USPC ..... 431/156; 431/289; 431/290; 29/428

(58) Field of Classification Search
USPC ..... 431/156, 289, 290, 428; 29/428
See application file for complete search history.

(56) References Cited

U.S. PATENT DOCUMENTS

| | | | | |
|---|---|---|---|---|
| 9,852 | A | 7/1853 | Barnes | |
| 345,461 | A | 7/1886 | Tyrell | |
| 1,091,354 | A | 3/1914 | Kowalsky | |
| 1,138,240 | A | 5/1915 | Nash | |
| 2,176,536 | A | 10/1939 | McCauley | |
| 2,765,481 | A | 10/1954 | Manhart et al. | |
| 3,194,955 | A | 7/1965 | Koch | |
| 4,187,532 | A | 2/1980 | Naffier | |
| 4,755,135 | A | 7/1988 | Kwok | |
| 5,057,005 | A * | 10/1991 | Kwok | 431/253 |
| 6,468,071 | B2 * | 10/2002 | Zou | 431/290 |
| 6,716,026 | B1 | 4/2004 | Beougher | |

(Continued)

OTHER PUBLICATIONS

Search Report, PCT/US2008/79259, Oct. 9, 2008, TGI Brands.
Report of Patentability, PCT/US2008/79259, Oct. 9, 2008, TGI Brands.

*Primary Examiner* — Kenneth Rinehart
*Assistant Examiner* — William Corboy
(74) *Attorney, Agent, or Firm* — John T. Connors; Connors & Assoc. PC

(57) ABSTRACT

A candle with a smooth exterior surface is configured so that it has a size and shape to substantially fill a hollow interior of the receptacle. The receptacle has an open mouth and a hollow interior having a smooth surface. The smooth exterior surface of the candle and smooth interior surface of the receptacle are in contact and slide past each other upon inserting the candle into the hollow interior to seat the candle on a moveable platform that is near a base end of the receptacle. After the candle is partially burned so an outer end thereof is burned away and displaced from the open mouth of the receptacle, the platform is advanced inward to move the outer end of the candle towards the open mouth to reposition the displaced outer end nearby the open mouth of the receptacle.

12 Claims, 10 Drawing Sheets

U.S. PATENT DOCUMENTS 6,886,959 B2 5/2005 Record
2001/0029003 A1 10/2001 Zou
2005/0254232 A1* 11/2005 Bentley et al. ..... 362/161

* cited by examiner

RC
D
M
LED
X
R
I
BM
E2
S1
P
10
B1
12a
12
12b
B
B2
12c

LED
D
AAA 2
RC
HS
P
W
R
E3
W
a
C
h1
h2
S1
S2
E2
E1
S4
18
P
12
10
B1

12a
12
12c
B
12b
B2
HS

IV
III
I
II
G
14
18
12

M
IS
W
R1
20
BM
C1

VP
d2
W
M
R1
BM
d1
P1
20
C1

Fig. 8A
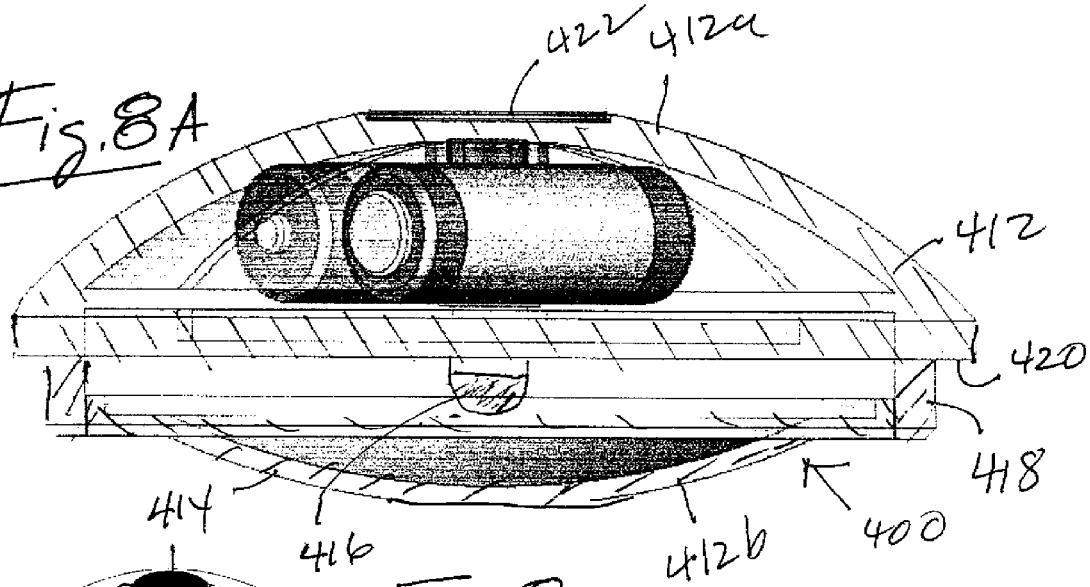
Fig. 8
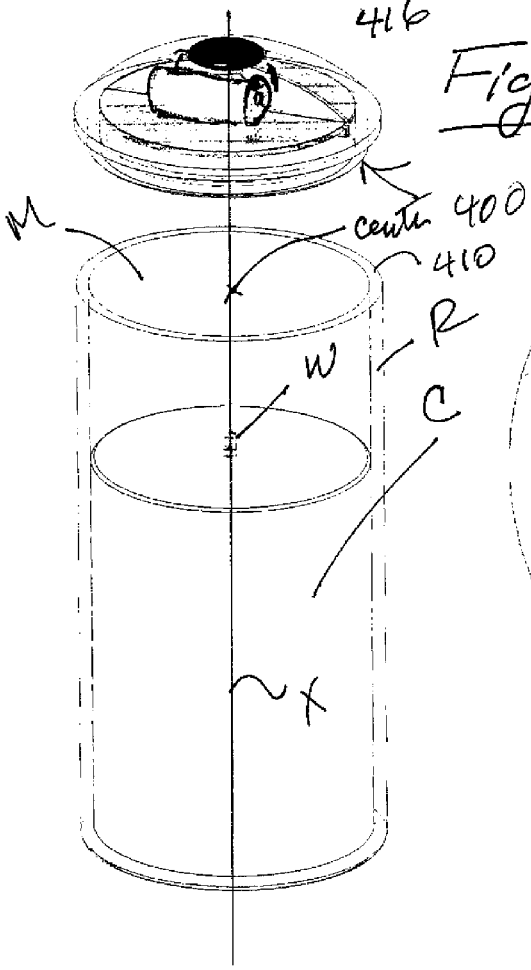
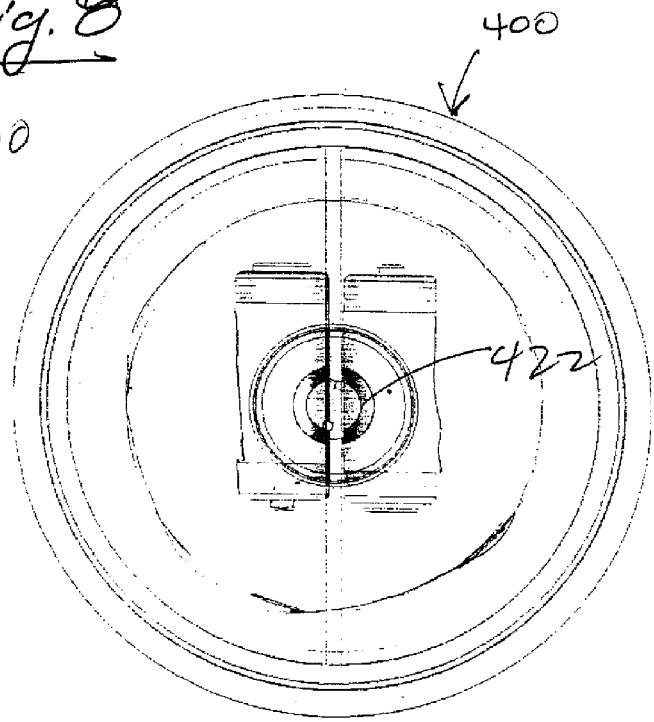
Fig. 8B

CANDLEHOLDER AND METHOD

RELATED PATENT APPLICATIONS & INCORPORATION BY REFERENCE

This application is an international application filed under the Patent Cooperation Treaty and claims the benefit under 35 USC 119(e) of U.S. Provisional Patent Application No. 60/998,145, entitled "Twist-up Candle Container and Method of Use," filed Oct. 9, 2007, and U.S. Provisional Patent Application No. 61/011,762, entitled "Twist-up Candle Container with LED Light Cover and Method of Use," filed Jan. 22, 2008. All these related provisional applications are incorporated herein by reference and made a part of this international application. If any conflict arises between the disclosure of the invention in this international application and that in the related provisional application, the disclosure in this international application shall govern. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "rectangular" includes square.

The words "substantially" and "essentially" have equivalent meanings.

BACKGROUND

Candles may be free standing or they may be enclosed within a hollow receptacle. In the latter case, typically the exterior surface of the body of the candle is bonded to the interior surface of the hollow receptacle. For example, a molten wax is poured into the interior of the receptacle with a wick extending from an inner end of the candle to an outer end of the candle. The candle's outer end is at or nearby an open mouth of the receptacle. Upon solidifying the wax adheres to the interior surface of the receptacle. Consequently, the exterior of the candle and the receptacle's interior surface have their contacting surfaces bonded to each other, so the candle and receptacle cannot move relative to each other. When the wick is ignited, the top surface of the body of the candle is consumed and the candle's outer end recedes with respect to the open mouth of the receptacle. The flame at the candle's wick is snuffed out and reignited from time to time, and the candle's outer end continues to recede as this process is repeated over the life of the candle. Consequently, the distance between the mouth of the receptacle and the candle's outer end continually increases, making it more difficult to access the wick to reignited the candle. The flame is also lowered deeper and deeper into the interior of the candle, diminishing the light output and obstructing the view of the flame.

Lighting devices, for example, night lights and tea lights, are sometimes used as substitutes for candles. It would be commercially advantageous from a marketing perspective to combine the use of such lighting devices and candles.

SUMMARY

My candleholder and method have one or more of the features depicted in the embodiments discussed in the section entitled "DETAILED DESCRIPTION OF SOME ILLUSTRATIVE EMBODIMENTS." The claims that follow define my candleholder and method, distinguishing them from the prior art; however, without limiting the scope of my candleholder and method as expressed by these claims, in general terms, one or more, but not necessarily all, of its features are:

One, in my candleholder and method the candle used is pre-molded rather than formed within a receptacle. The candle has a body with an inner end and an outer end, and the inner and outer ends are connected by a smooth exterior surface. The candle body has a predetermined original height, a predetermined cross-sectional configuration, and predetermined dimensions, for example, it may have a cylindrical, conical, or a block shape, the cross-sectional configuration being a square or rectangular in cross-section. The exterior surface of the candle may be lubricated.

Two, a candleholder includes a hollow candle receptacle that receives the candle and a moveable platform that is periodically advanced to move the outer end of the candle towards an open mouth of the receptacle. The open mouth is an entryway to the receptacle's interior, which has a predetermined cross-sectional configuration substantially of the same shape and dimensions as the cross-sectional configuration of the candle. The receptacle's height is greater than the original height of the candle. The interior has a smooth surface. The smooth exterior surface of the body of the candle and the smooth interior surface of the receptacle are in contact and slide past each other as the candle is received within the interior of the receptacle and moves within the interior. The candle's exterior sidewall surface is initially in contact with substantially the entire smooth interior receptacle surface. The candle's outer end, however, recedes from the open mouth as the candle burns to reduce the area of contact between these surfaces.

Three, the receptacle may rest on a base, so with the base resting on a horizontal surface, the candle is within the receptacle in an upright substantially vertical orientation with the inner end of the candle resting on the platform and the outer end of the candle is nearby the open mouth prior to igniting a wick of the candle. Thus, as the body of the candle is consumed by burning, the outer end of the candle recedes inward and away from the open mouth of the receptacle, reducing the original height of the candle to a reduced height. The base, or a portion thereof, may be twisted, or rotated, with respect to the receptacle to advance the candle towards the open mouth after a substantial portion of the candle is consumed by burning. The base may include at least one hand actuated member that is mounted to be manually rotated and is operably connected to the platform to advance the platform into the interior and apply pressure against the inner end of the candle and advance the candle towards the open mouth of the candle receptacle.

Four, a cover member having a dual function may be used with my candleholder or with a conventional candle holder. The cover member is a lighting device and a receptacle lid. The receptacle has a rim forming the open mouth of either type of candleholder. This rim has a predetermined configuration and dimensions. When the receptacle is oriented vertically, the cover member is sized to fit snug in the open mouth. The cover member includes a body member including a light-transmitting window and a battery-energized light within the body member. The body member has opposed sides; one may be a domed light-transmitting window and the other side leveled to sit on a horizontal surface. At least one side includes an insert element projecting outward from an adjacent ceiling section of the body member having dimensions greater than the insert element. The insert element has a perimeter with substantially the same configuration and the same dimensions as the rim forming the open mouth. The insert element has its center along a centerline. On covering the open mouth a user aligns the insert element's centerline with a centerline of the receptacle and orients the cover member so it is in registration with the open mouth so these centerlines are coextensive. The user then inserts the aligned and registered insert element into the open mouth, pushing the cover member inward until the ceiling adjacent the insert element from this one side abuts the rim of the open mouth. The battery-energized light may be facing inward into the interior of the receptacle. The other side of the body member may be shaped so that it may be inverted and placed on the rim so the battery-energized light is facing outward and may be viewed directly rather than through the receptacle.

Five, initially the candle substantially fills the entire receptacle interior except for a vacant portion nearby the open mouth, and a part of the cover member is received within this vacant portion when carried on the top of the upright candleholder and seated in the open mouth. The cover member is moveable between a first position seated within the open mouth to direct illumination from the battery-energized light inward into the interior of the receptacle and an inverted second position seated within the open mouth to direct illumination from the battery-energized light outward away from the interior of the receptacle. One side of the cover member faces inward towards the open mouth when the cover member is seated in the open mouth. This one side includes the light transmitting housing so, when the cover member is removed and placed to rest on a substantially horizontal surface with its opposed leveled side resting on a horizontal surface, the cover member is inverted so the light transmitting housing is exposed to the view of an observer.

Six, the platform is mounted to be manually moved to advance the platform towards the open mouth of the receptacle after burning the candle to lower the original candle height to the reduced height. The smooth exterior surface of the body of the candle and the smooth interior surface of the receptacle are in contact and slide past each other as the outer end of the candle is repositioned to nearby the open mouth. In response to the application of pressure the platform advances in a linear direction. The platform may be a component of a plunger member mounted at the second end of the receptacle to move inward and push the candle towards the open mouth. Different embodiments employ different means for manually advancing the plunger member, and consequently the platform, inward.

One advancing means comprises a plurality of cam elements stacked one upon the other with an inner most cam element next to the plunger member. The cam elements are mounted to each other to be repositioned relative to each other to vary the height of the stacked cam elements to advance the candle towards the open mouth of the candle receptacle. The base, receptacle, platform or plunger member, and stacked cam elements may be aligned along a centerline of the candleholder. Each individual cam element may include a ramp section having a first side with a track therein and a second side with a finger thereon beneath a terminal end of the track. Each finger of one stacked cam element is within the track of another stacked cam element directly beneath said one stacked cam element. The stacked cam elements are free to rotate relative to each other in one direction and this causes the stack height to increase. The base may comprise inner and outer members detachably connected to provide a housing for the stack of cam elements, said cam elements being initially assembled in a stored position where the stack height is essentially at a minimum and essentially the entire stack is within the base.

Another advancing means comprises a gear system connected to the plunger member that upon manual rotation of at least one gear of the gear system advances the plunger member. The gear system may comprise at least two gears with one being a central gear mounted along a centerline of the candleholder and each of the other gears are individually connected to a screw member that extends through the plunger member and into the body portion of the candle. The advancing means may also comprise a screw member along a centerline of the candleholder and mounted for manually rotation and operably connected to the plunger member so rotation of the screw member advances the plunger member. Yet another advancing means comprises a key member detachably attached to a cover member that removably fits over the open mouth of the receptacle. The key member when detached is manually inserted through a key hole to engage the plunger member and advance the plunger member by manually manipulating the key member.

My method includes using a lighting device as a lid to cover an open mouth of candle receptacle having a rim with a predetermined configuration and dimensions forming the open mouth. This method comprises the steps of (a) providing the lighting device with (a) providing the lighting device with a body member including a light-transmitting window and a battery-energized light within the body member, said body member having opposed sides and a centerline intersecting a center of the body member, at least one side including an insert element projecting outward from an adjacent ceiling member on the body member, said ceiling member having dimensions greater than the insert element and said insert element having a perimeter with substantially the same configuration and the same dimensions as the open mouth, (b) aligning the centerline of the with a centerline of the receptacle so that, upon covering the open mouth with the lighting device, an insert element from one side is inserted into the open mouth and in registration with the open mouth, and (c) pushing the lighting device inward until the ceiling adjacent the insert element from said one side abuts the rim of the open mouth.

My method also includes mounting a candle in a receptacle having an open mouth. This method comprises the steps of (a) configuring the candle so that said candle has a size and shape to substantially fill a hollow interior of the receptacle, said hollow receptacle interior having a smooth surface and said candle having a smooth exterior surface and an outer end and an inner end, (b) inserting the candle into the hollow interior of the receptacle with said smooth exterior surface of the candle and smooth interior surface of the receptacle being in contact and sliding past each other, so that the outer end of the candle is near said open mouth and the inner end is seated on a moveable platform that is initially near a base end of the receptacle, and (c) after the candle is partially burned so the outer end thereof is burned away and receded from the open mouth of the receptacle, advancing the platform inward to move said receded outer end of the candle towards said open mouth to reposition the receded outer end nearby said open mouth, said smooth exterior surface of the candle and the smooth interior surface of the receptacle being in contact and sliding past each other as the receded outer end of the candle is repositioned to nearby said open mouth.

These features are not listed in any rank order nor is this list intended to be exhaustive.

DESCRIPTION OF THE DRAWING

Some embodiments of my candleholder and method are discussed in detail in connection with the accompanying drawing, which is for illustrative purposes only. This drawing includes the following figures (Figs.), with like numerals indicating like parts:

FIG. 4A is a top plan view of the cam element shown in FIG. 4.

FIG. 8 is an exploded perspective view of another embodiment of my lighting device used as a lid for a conventional candleholder.

FIG. 8A is a cross-sectional view of my lighting device shown in FIG. 8.

FIG. 8B is a top plan view of my lighting device shown in FIG. 8.

DETAILED DESCRIPTION OF SOME ILLUSTRATIVE EMBODIMENTS

General

Figures 1, 2, 3:
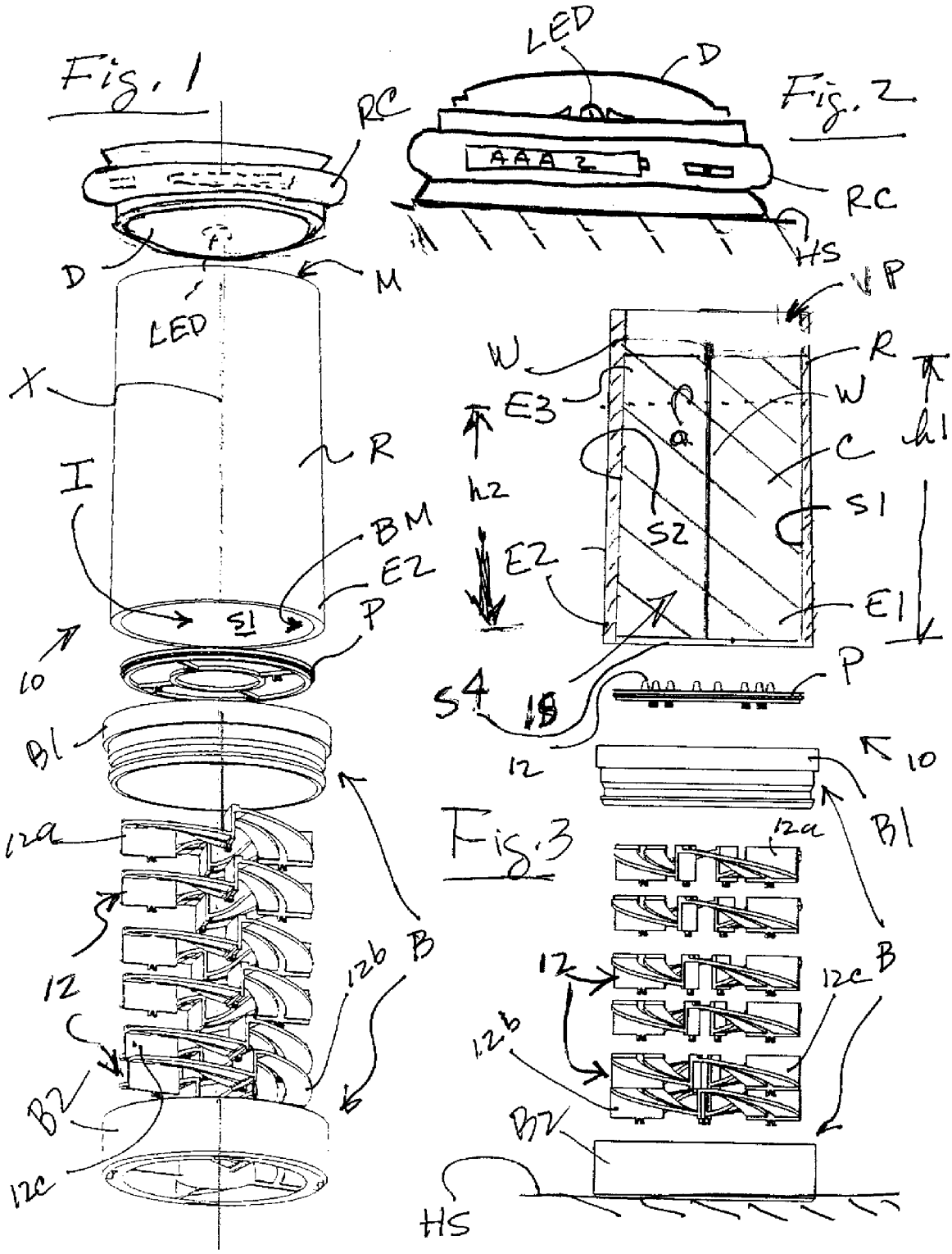
FIG. 1 is an exploded perspective view of one embodiment of my candleholder looking at an underside of my candleholder.
FIG. 2 is a side view of one embodiment of my cover member removed form the receptacle of the embodiment of my candleholder illustrated in FIG. 1 and shown inverted and resting on a horizontal surface.
FIG. 3 is an exploded side view of the embodiment of my candleholder illustrated in FIG. 1 showing in cross-section a receptacle holding a candle that is inserted into an open mouth of the receptacle and slides into a hollow interior of the receptacle until its inner end abuts a moveable platform.

The different embodiments of my candleholder are designed to interact with a pre-molded candle C held within a receptacle R. The receptacle R may be made of an opaque, transparent or translucent material, or have a coated or decorated exterior. It has an open mouth M and may have an open bottom mouth BM. The candle may be inserted into the open mouth M or the open bottom mouth BM or either, depending on the configuration of the receptacle R. The receptacle R may be seated on a base B and it has a hollow interior I that receives the candle C. As discussed subsequently in greater detail, the interior I may have many different cross-sectional configurations, and may be uniform along its length such as a cylindrical shaped interior (FIG. 3) or vary in dimensions along its length such as a truncated conical interior (FIG. 1B). The interior I has a smooth internal surface S1, and an exterior of the candle C has a smooth surface S2. These smooth surfaces S1 and S2 contact each other and slide relative to each other as the candle C enters the receptacle and as the candle is periodically moved towards the open mouth M when a substantial portion is burned away. At least one of the contacting surfaces S1 and S2 may be lubricated to reduce friction between these contacting surfaces. For example, the exterior surface S2 of the candle C may have an oil, or other lubricant, applied directly thereto prior to insertion into the receptacle R, or the body of the candle may include a lubricant that exudes from the candle body onto the exterior surface S2.

The candle C has a size and shape configured so, prior to burning the candle, the candle fills substantially the entire volume of the hollow interior I of the receptacle R, except for a small vacant portion VP of the hollow interior I near the open mouth M. This vacant portion VP is less than about 20 percent of the total volume of the interior I. This enables a removable cover member RC to be seated in the open mouth M, partially projecting into the vacant portion VP near the open mouth. The candle C is placed into the hollow interior I of the receptacle R and the receptacle is placed on the base B, and then the cover member RC is placed in position. As discussed subsequently in greater detail, the removable cover member RC includes a batter-energized light, for example, a light emitting diode LED seated beneath a light-transmitting dome D. The cover member RC may be positioned on top of the receptacle R to face inward towards the hollow interior I or to face outward away from the hollow interior I or removed from the top of the receptacle and set on a horizontal surface HS as shown in FIG. 2.

The candle C may be inserted into either the open mouth M or the open bottom mouth BM. For example, an alternate embodiment of my candleholder 20 is depicted in FIGS. 1B and 1C. My candleholder 20 uses a receptacle R1 having a tapering inside wall W converging into the open mouth M of the receptacle R1 and diverging into the open bottom mouth BM. Thus, the interior I of the receptacle R1 has an internal space IS substantially in the configuration of a truncated cone. A candle C1 is configured as a truncated cone of substantially of the same dimensions as the truncated conical internal space IS and substantially fills this space (except for the vacant portion VP) when placed with the interior I as illustrated in FIG. 1C. In contrast as depicted in FIG. 3, the interior I of the receptacle R of the embodiment of my candleholder generally designated by the numeral 10 has an internal space IS substantially in the configuration of a cylinder. The candle C is configured as a cylinder of substantially of the same dimensions as the cylindrical internal space IS and substantially fills this space (except for the vacant portion VP) when placed with the interior I as illustrated in FIG. 3.

Upon insertion of the candle C as best shown in FIG. 3, an inner end E1 (FIG. 3) of the candle C seats itself on a moveable platform P that is near a base end E2 of the receptacle R. After a wick W of the candle C is ignited to partially burned away an outer end E3 of the candle C originally nearby the open mouth M, this outer end E3 is displaced from the open mouth M to the receded position depicted by a dotted line a in FIG. 3. With the base B resting on a horizontal surface HS, the candle C is within the receptacle R in an upright substantially vertical orientation with the inner end E1 of the candle resting on the platform P and the outer end E3 of the candle being nearby the open mouth M prior to igniting the wick W. As the body of the candle is consumed by burning, the outer end E3 of the candle recedes inward and away from the open mouth M, reducing the original height h1 of the candle to a reduced height h2. Snuffing out a burning wick W may result in a thin molten surface layer solidifying to form a readily frangible crust at the outer end E3 of the candle C that can be broken with the advance of the candle C towards the open mouth M.

Periodically, the platform P is manually advanced inward to move the outer end E3 of the candle C towards the open mouth M to reposition the receded outer end E3 to nearby the open mouth M. The base end E2 of the receptacle may be open so the platform P moves into this open base end as it advances. The smooth exterior surface S2 of the candle C and the smooth interior surface S1 of the receptacle R are in contact and slide past each other as the receded outer end E3 of the candle is repositioned to nearby the open mouth M.

The platform P functions as a plunger member that upon actuation advances the candle towards the open mouth. The platform P may be pressed against the inner end E1 of the candle C so that pins 12 on the platform's surface S3 penetrate a flat underside surface S4 (FIG. 3) of the candle's inner end E1 and secure the platform to the candle in this position. Replacement candles may be manufactured with the platform pre-attached to the candle. Thus, when the candle C is substantially consumed with only trace amounts of wax remaining of the platform P, this used platform with the trace wax may be discarded and a replacement candle with an attached platform substituted.

Figure 5:
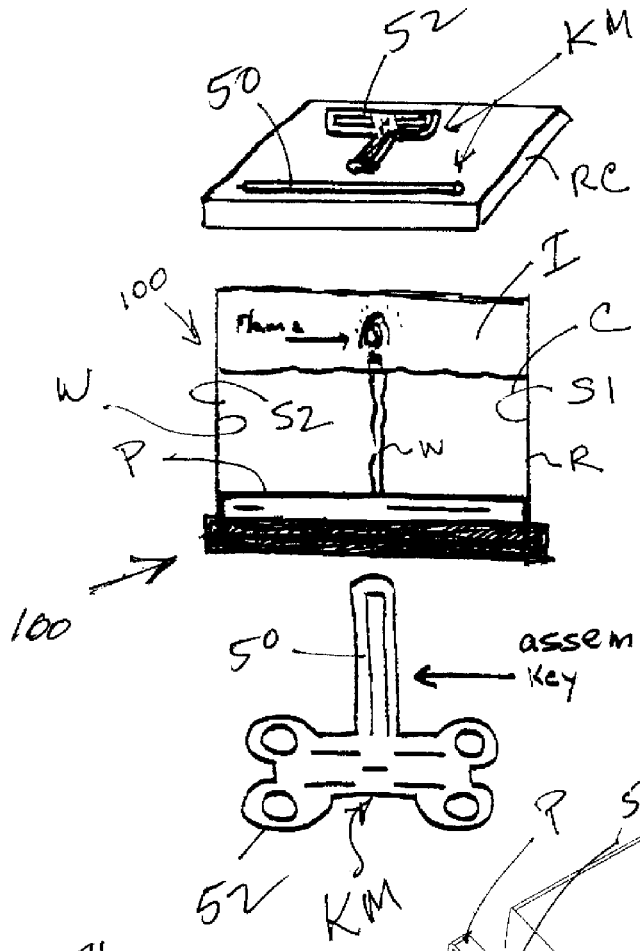
FIG. 5 is an exploded schematic view of another embodiment of my candleholder showing a cover member with a key member held thereby.
Figures 5B, 5C, 5D:
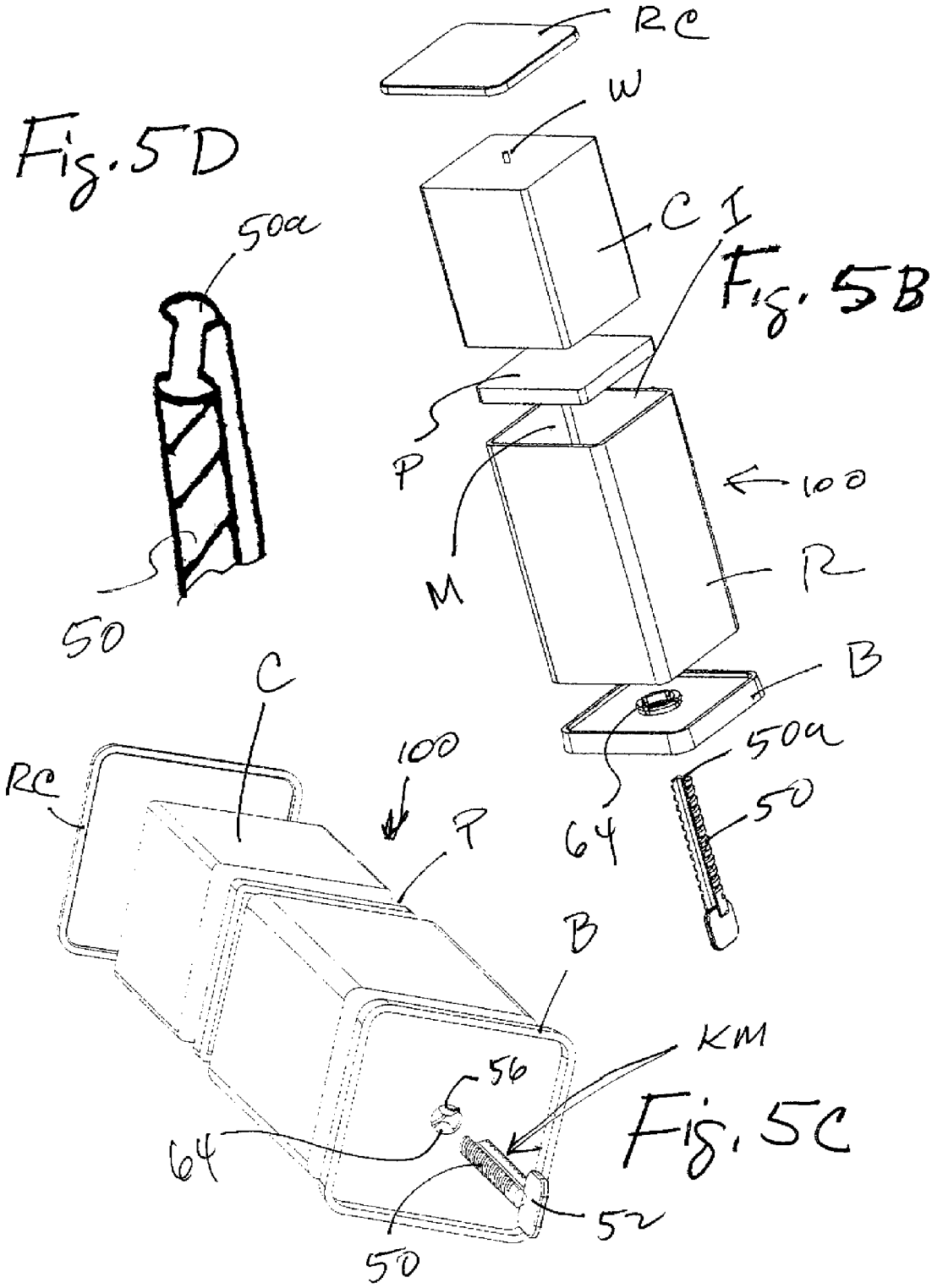
FIG. 5B is an exploded perspective view of the embodiment of my candleholder shown in FIG. 5 looking at the topside of the candleholder.
FIG. 5C is another exploded perspective view of the embodiment of my candleholder shown in FIG. 5 looking at the underside of the candleholder.
FIG. 5D is a fragmentary perspective view of the tip of the key member shown in FIG. 5.
Figure 6:
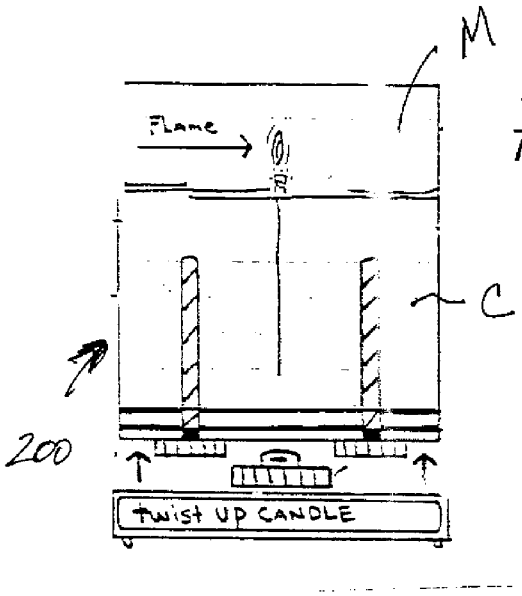
FIG. 6 is an exploded schematic view of yet another embodiment of my candleholder using a gear system having two gears to advance a platform carrying a candle.
Figure 6B:
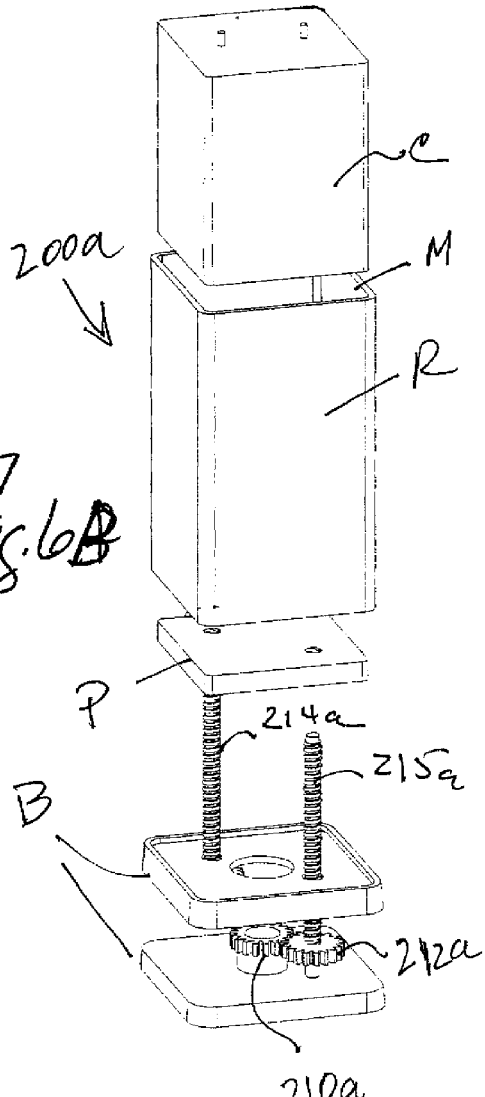
FIG. 6B is an exploded perspective view of another embodiment of my candleholder looking at the underside of the candleholder wherein this embodiment uses a gear system having two gears to advance a platform carrying a candle.
Figure 6A:
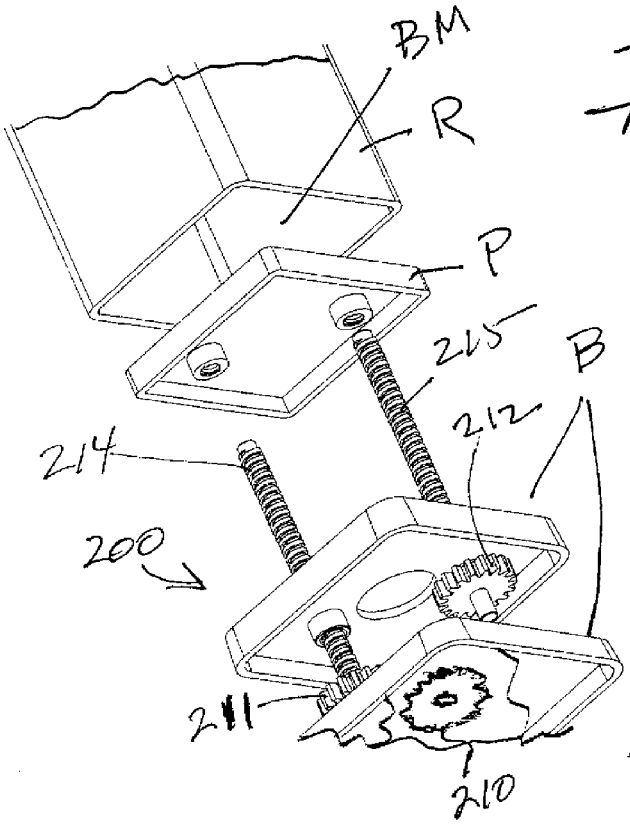
FIG. 6A is a fragmentary exploded perspective view of the embodiment of my candleholder shown in FIG. 6 looking at the underside of the candleholder.
Figure 7:
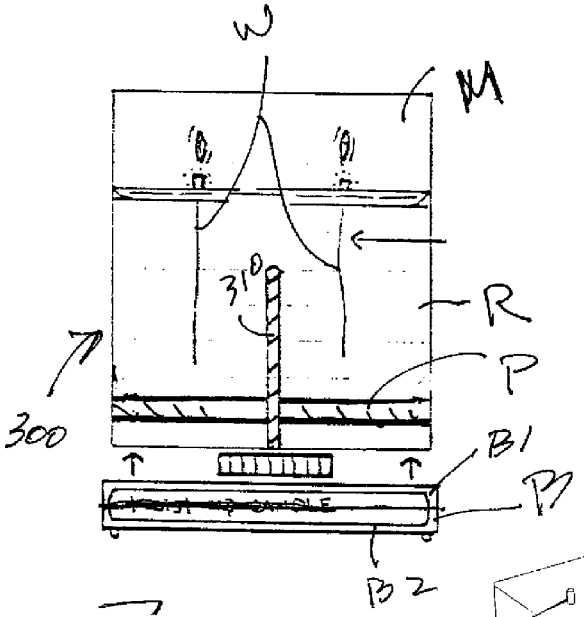
FIG. 7 is an exploded schematic view of still another embodiment of my candleholder using a screw to advance a platform carrying a candle.
Figure 7B:
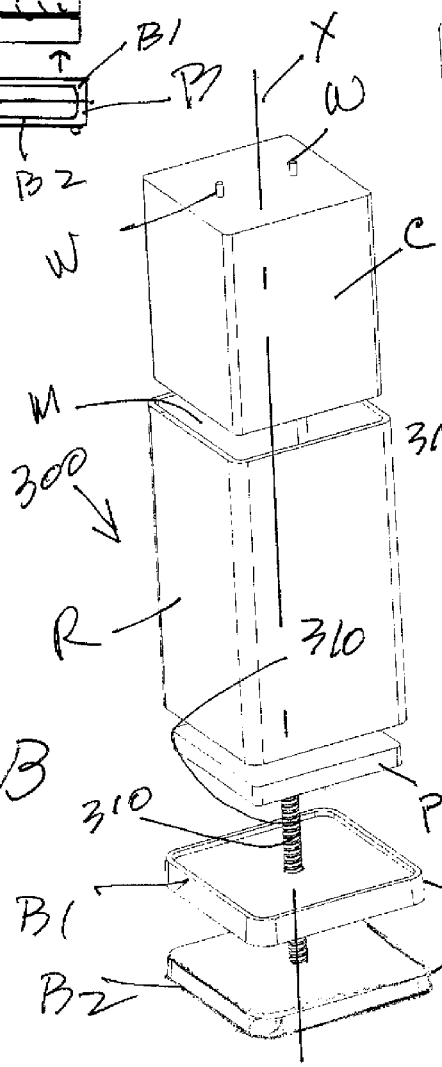
FIG. 7B is an exploded perspective view of the embodiment of my candleholder shown in FIG. 7 looking at the topside of the candleholder.

The following illustrative embodiments depict different means for manually advancing the platform P or plunger member to advance the candle C towards the open mouth M of the candle receptacle R. The embodiment depicted in FIGS. 1 through 4D is generally designed by the numeral 10 and uses a plurality of cam elements 12 as the advancing means. The embodiment depicted in FIGS. 5 through 5C is generally designed by the numeral 100 and uses a key member KM as the advancing means. The embodiment depicted in FIGS. 6 and 6A is generally designed by the numeral 200 and uses a gear system GS having three gears as the advancing means, and the embodiment depicted in FIG. 6B is generally designed by the numeral 200*a* and uses a gear system GS having two gears as the advancing means. The embodiment depicted in FIGS. 7 through 7B is generally designed by the numeral 300 and uses a screw member SM as the advancing means. FIGS. 8 through 8B depicted an alternate embodiment of the cover member RC generally designated by the numeral 400 and is illustrated being used with a conventional candleholder where the candle C is formed in situ in a molten state that hardens with in the receptacle.

FIGS. 1 through 4D

As illustrated in FIGS. 1 through 4D, the candleholder 10 has the removable cover member RC, receptacle R, platform P, and base B aligned along a common centerline X. All these components have a generally circular shape with the centerline X intersecting the centers of these components. The platform P may have approximately the same, but slightly smaller diameter as the cylindrical receptacle R, so that it may freely move within the cylindrical shaped interior I of the receptacle R. In the case of the receptacle R1 (FIG. 1C), depending on the slope of the tapering wall W, the diameter d1 of the platform P1 may be less than the diameter d2 of the circular open mouth M of the receptacle R1.

Figure 4:
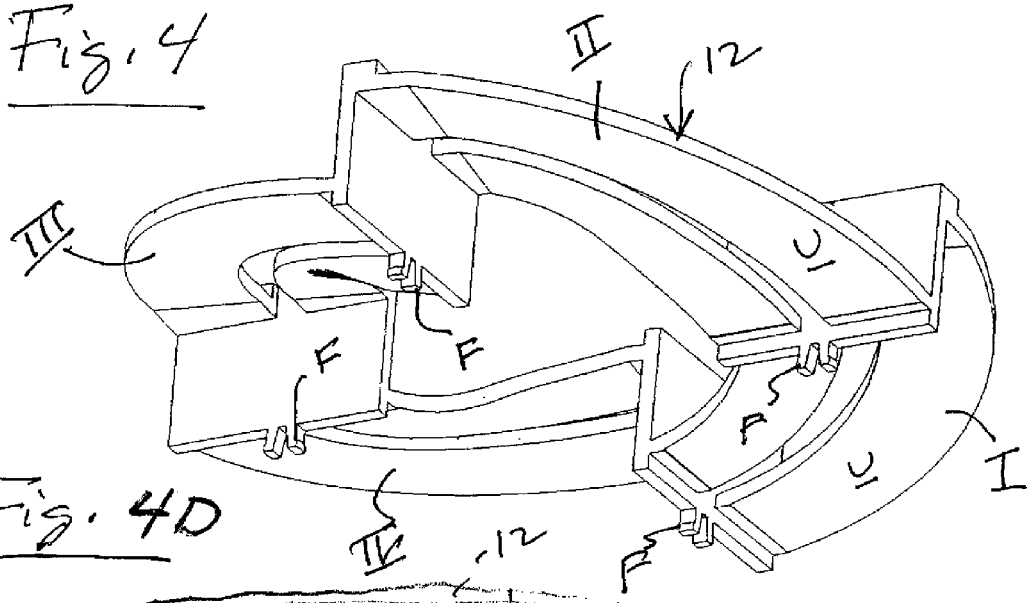
FIG. 4 is a perspective view of a stackable cam element looking at the underside of the cam element.
Figure 4D:
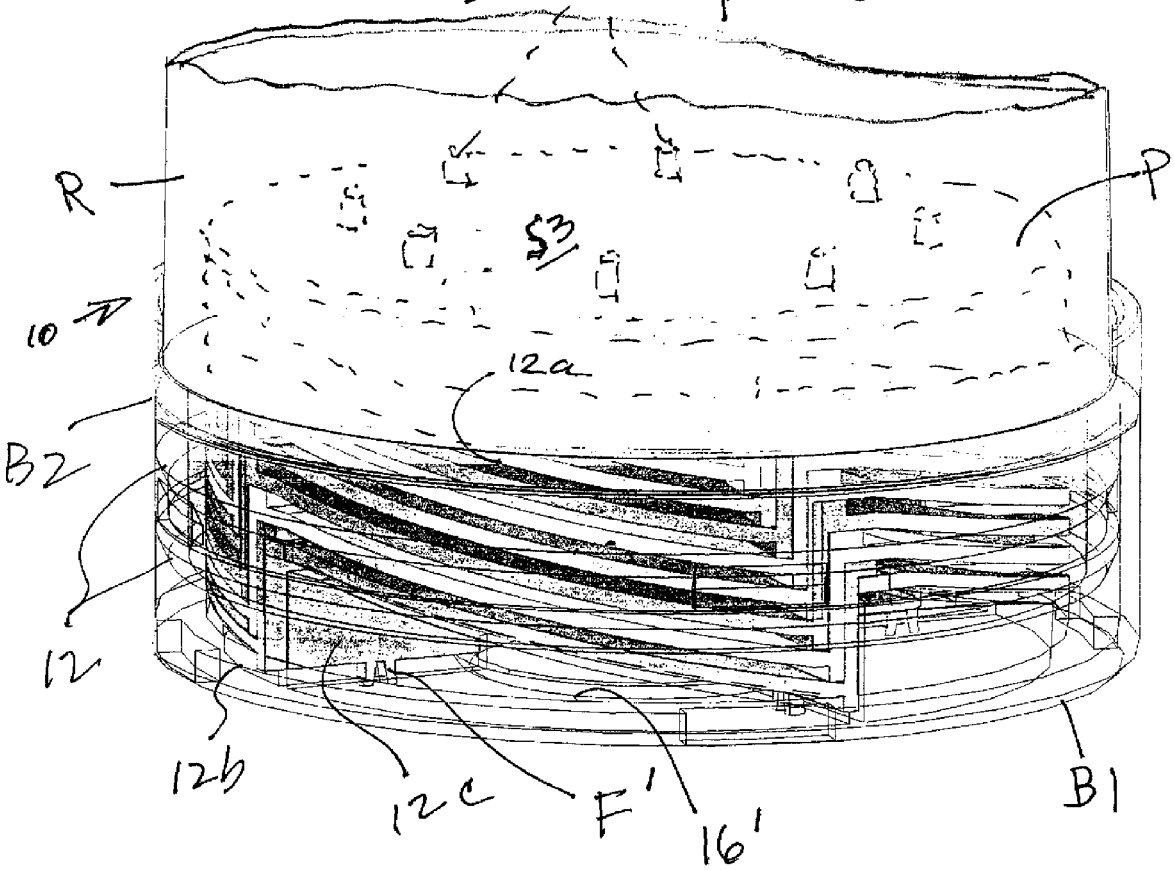
FIG. 4D is a perspective view of a plurality of the cam elements stacked one on top of the other and shown in phantom lines within a base for the embodiment of my candleholder illustrated in FIG. 1.
Figure 4B:
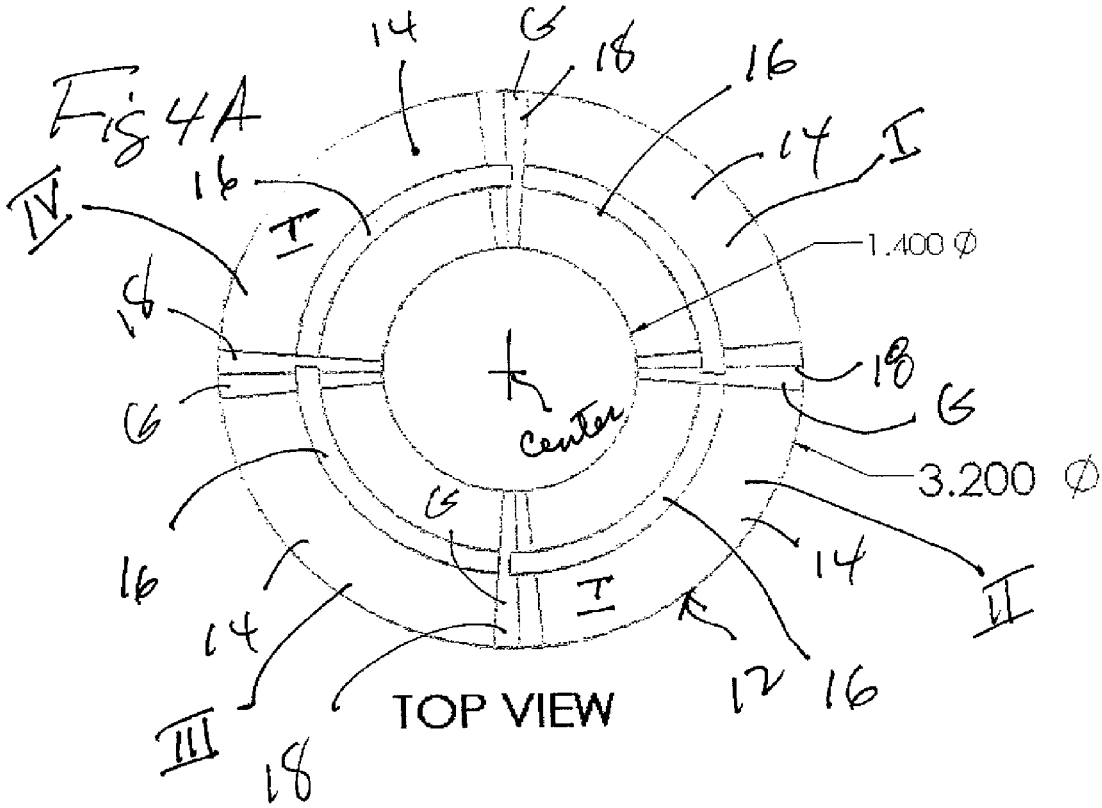
FIG. 4B is a side view of the cam element shown in FIG. 4.
Figure 4B:
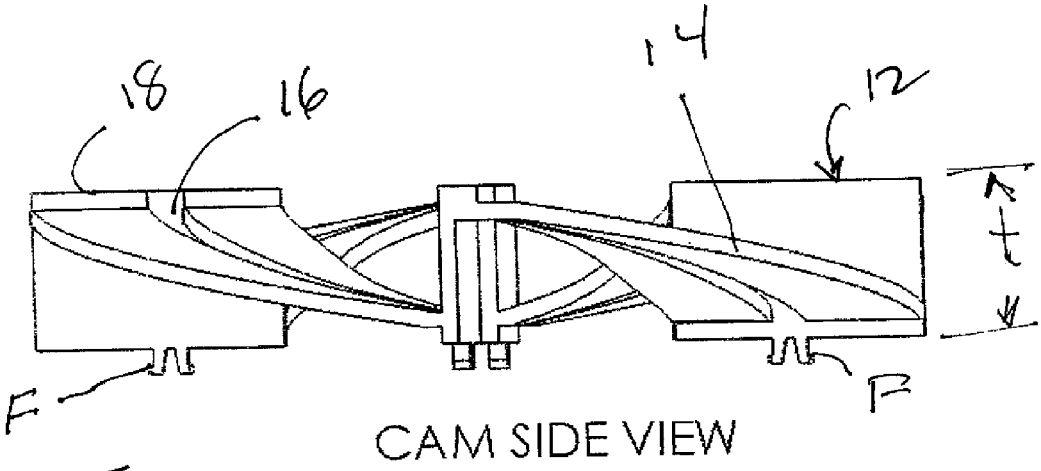

As illustrated in FIG. 4D, the base B comprises an inner cap member B1 and an outer foundation member B2 that are detachably connected so that, upon assembly, provide a housing for a stack of cam elements 12. The platform P may also be within the base B or slightly advanced into the open circular bottom mouth BM of the receptacle R. The cam elements 12 are initially assembled in a stored position where the stack height is essentially at a minimum and the platform P is within the base B. If not already in an advanced position, the platform P moves into the receptacle R as the cam elements 12 are repositioned to advance the platform and press it against the inner end E1 of the candle.

Figure 1A:
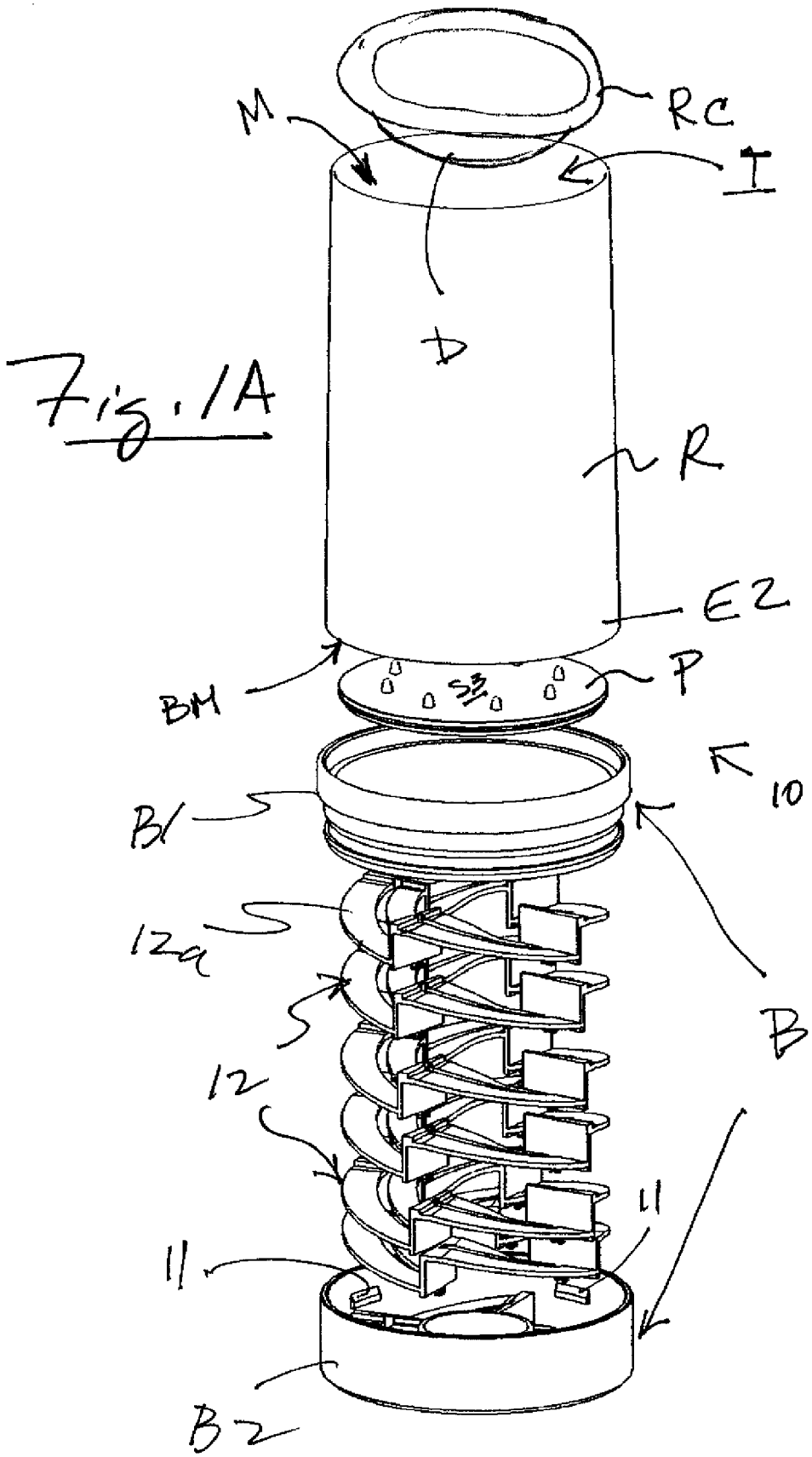
FIG. 1A is an exploded perspective view of one embodiment of my candleholder looking at a topside of my candleholder.
Figure 4C:
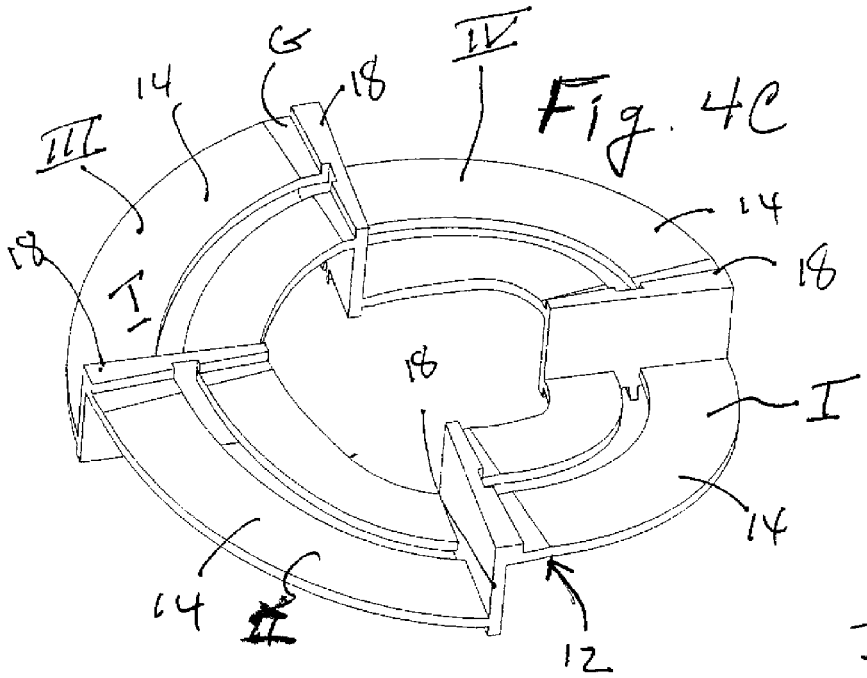
FIG. 4C is a perspective view of the cam element shown in FIG. 4 looking at the topside of the cam element.
Figure 1B:
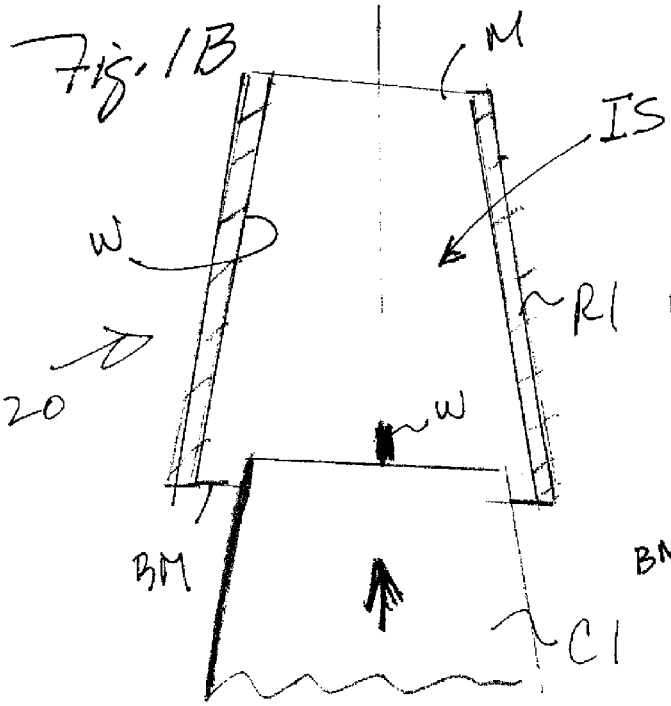
FIG. 1B is a cross-sectional view of an alternate embodiment of a receptacle for my candleholder illustrated in FIG. 1, showing a pre-molded candle being inserted into the receptacle through a bottom open mouth of the receptacle.
Figure 1C:
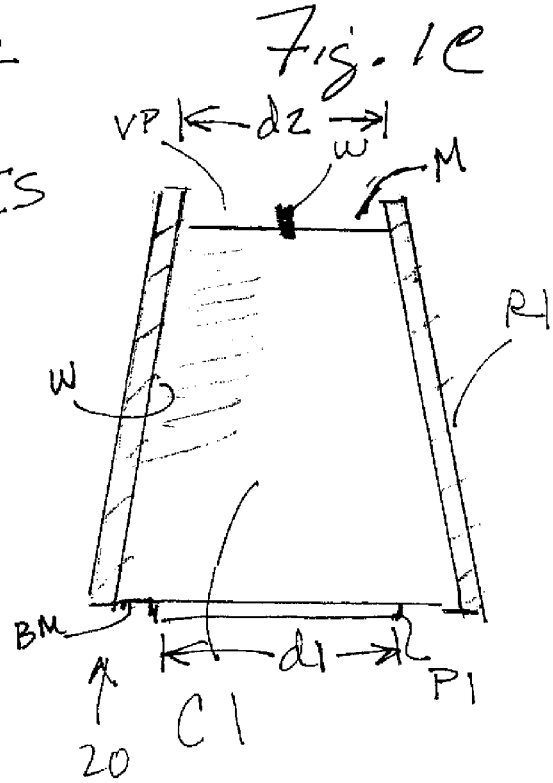
FIG. 1C is a cross-sectional view similar to that of FIG. 1B showing the pre-molded candle completely inserted into the receptacle.

The stack housed with the base is plurality of essentially identical cam elements 12 that are free to rotate around the common centerline X that intersects their centers. The cam elements 12 are generally annular in shape and are stacked one upon the other with an inner most cam element 12*a* next to the platform P and an outer most cam element 12*b* attached to the foundation member B2 by interlocking elements, for example, a tab (not shown) on the cam element 12*b* that fits into slots 11 (FIG. 1A) in one component of the base B. Consequently, rotation of the foundation member B2 in the one direction causes the attached adjacent cam element to rotate in this same one direction. The cam elements 12 are so mounted to each other to be repositioned relative to each other to vary the height of the stacked cam elements to advance the candle C towards the open mouth M of the receptacle R.

As depicted best in FIGS. 4, 4A, 4B and 4C, each individual cam element 12 has a four circular sections I, II, III and IV corresponding to approximately one quadrant of a circle. Pairs of adjacent circular sections are connected at adjacent ends by a common radial plate-type stop member 18. The four stop members 18 are equally spaced apart, and four circular sections I, II, III and IV are of approximately the same length. Each circular section I, II, III and IV has a corresponding spiraling topside T and underside U. The topside T functions as a ramp section 14. There is a recessed track 16 in each ramp section 14 corresponding to one quadrant or approximately ¼ of a circle. The four ¼ circular tracks have a common center, which is the center of the cam element 12. A groove G lies across each track 16 adjacent a stop member 18. The underside U includes four pairs of fingers F equally spaced apart along the underside of each cam element 12. Each individual pair of fingers F projects outward from the underside U at a location substantially directly beneath the lower terminal end of a track in the topside T. The four individual pairs of fingers F of one stacked cam element are lodged respectively within each ¼ track 16 of the stacked cam element directly beneath it.

For example, as illustrated in FIG. 4D, the finger pair F' of the cam element 12*c* is lodged in the track 16' of the cam element 12*b*. Each individual section is positioned between a pair of stop members 18 so one end of each section is higher with respect to the other end when the cam elements are oriented horizontally. Thus, a quarter rotation of a cam element 12 in a counter-clockwise direction as viewed in FIG. 4A will lift an upper stacked cam element with respect to the stacked cam element immediately below it. Thus, the rotation of the foundation member B2 in a counter-clockwise direction as viewed in FIG. 4D causes the cam element 12*b* adjacent the foundation member to rotate in this one direction to lift a stacked cam element 12*c* (FIGS. 1 and 3) immediately above the cam element 12*b* as the pair of fingers F in the lifted cam element ride in the ¼ tracks 16 of the rotating cam element 12*b*. The lower edge of an upper stop member drops into the groove of a lower stop member when the stop members engage. Thus, another ¼ turn lifts another cam element, so with each ¼ turn a cam is lift a height corresponding to the thickness t (FIG. 4B) of a cam element FIGS. 5 through 5D My candleholder 100 is similar to my candleholder 10 in that they both use a base B on which is seated the receptacle R. The means for advancing the platform is a key member KM that is rotated to advance the platform P inward towards the open mouth M of the receptacle R. In my candleholder 100 the receptacle R has a rectangular or square cross-section and it may have a glass transparent sidewall W with a smooth internal surface S2 that slides along the smooth exterior surface S1 of the candle C. The platform P has a corresponding essentially identical configuration and dimensions as the rectangular or square cross-section interior I of the receptacle R and fits tight within the interior and will retain in a selected position until repositioned.

A cover member RC is used that retains a key member KM. The key member KM has two pieces: a shaft 50 and a crank member 52, both are removably lodged in separate channels in the exterior of the cover member RC as illustrated in FIG. 5. Upon dislodging these two pieces 50 and 52 they are attached to each other in a T-shape to assemble the key member KM. On portions of its exterior as shown in FIG. 5D, the shaft 50 has opposed identical indentations 60 and opposed threaded segments 62. The shaft 50 interacts with a complementary threaded keyhole element 64 fixedly seated within the opening 56 in the base B.

Figure 5A:
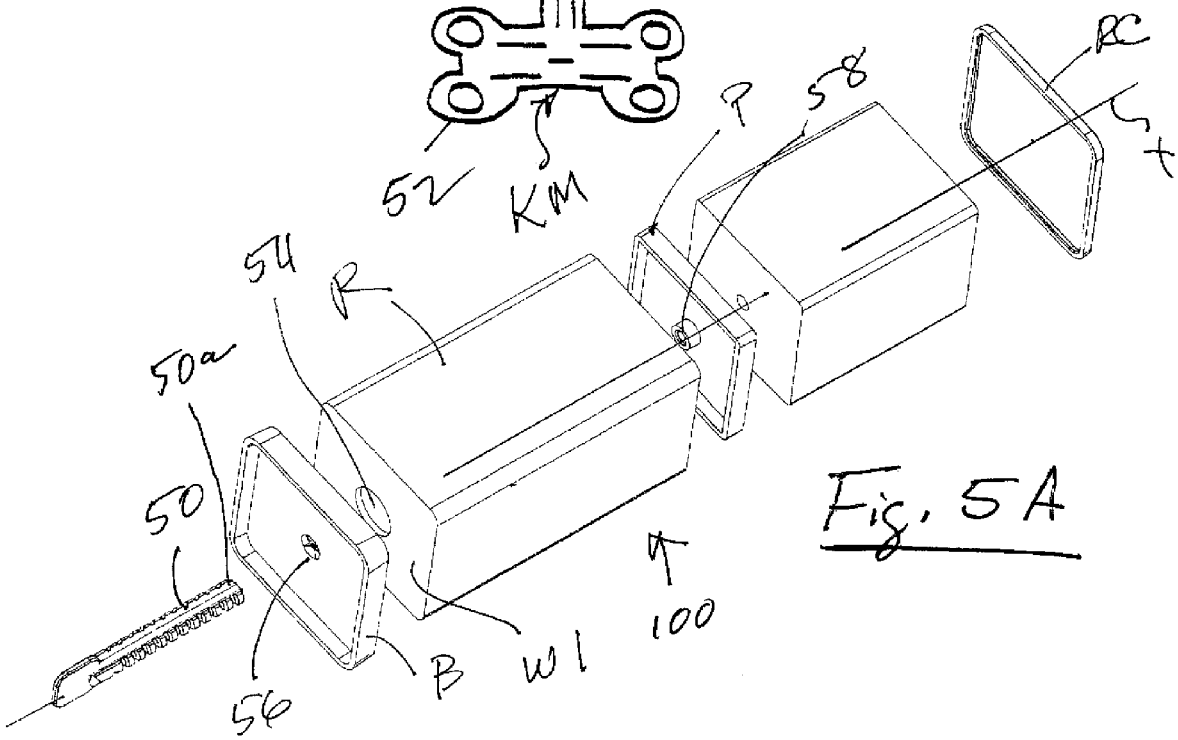
FIG. 5A is an exploded perspective view of the embodiment of my candleholder shown in FIG. 5 looking at the underside of the candleholder.

As best depicted in FIG. 5A, the receptacle R in my candleholder 100 has a bottom wall W1 having therein a central opening 54 along the centerline X of the receptacle R or candleholder 100. The base B is slightly larger than the perimeter of the receptacle R and it also has an opening 56 along the centerline X of the candleholder 100. The platform P, which is within the interior I of the receptacle R and free to move towards the open mouth M of the receptacle, has in its underside a holder 58 along the centerline X of the candleholder 100 for a tip 50*a* (FIG. 5D) of the shaft 50. The topside of the platform P is flat and solid as best shown in FIG. 5B. When the candle's outer end E3 has receded and the candle C is to be repositioned within the receptacle R, the shaft 50 of the assembled key member Km is inserted by a user into the opening 58. The user first manually slides the shaft 50 into the keyhole element 64 lengthwise along the centerline X until the tip of the shaft 50*a* will abut or be lodged in the holder 58. The keyhole element 64 is of the type that allows the shaft 50 to slide in and out lengthwise. Rotating the key member KM using its crank 52, while in the keyhole element 64 and the tip 50*a* against the platform engages threads (not shown) within the keyhole element 64 and the threaded segments 62 of the shaft 50 to advance the platform towards the open mouth M. Rotating the shaft a half turn in the opposite direction will realign the indentations 60 within the keyhole element 64 to allow the shaft 50 to be withdrawn from the keyhole element after advancing the shaft.

FIGS. 6 through 6B

My candleholders 200 and 200*a* are similar to my candleholder 10 in that they both use a base B with a cap member B1 and a foundation member B2 that is twisted or rotated to advance the platform P inward towards the open mouth M of the receptacle R. In each the advancing means for the platform P is a gear system GS. In my candleholder 200 the gear system GS has three gears 210, 211, and 212 and in my candleholder 200*a* the gear system GS1 has two gears 210*a* and 212*a*. The gears 210 and 212 are within the base B and mounted to the underside of the cap member B1 to engage in a planetary arrangement the center gear 211, which is mounted to the foundation member B2 so that rotating the foundation member rotates this center gear to rotate the other gears 210 and 212. The gears 210 and 212 are fixedly attached to lower ends of a pair of axles 214 and 215 that pass through the cap member B1 and penetrate into the body portion of the candle C. When the foundation member B2 is rotated, the platform P is moved along the axles 214 and 215 towards the open mouth M.

My candleholder 200*a* is like that of candleholder 200*a* only two gears 210*a* and 212*a* are used to advance the platform P along a pair of axles 214*a* and 215*a*. The gear 210*a* is mounted on the foundation member B2 so that rotating the foundation member rotates this gear 210*a*, which rotates the gear 212*a* that is fixedly attached to the axle 215*a*.

Figure 7A:
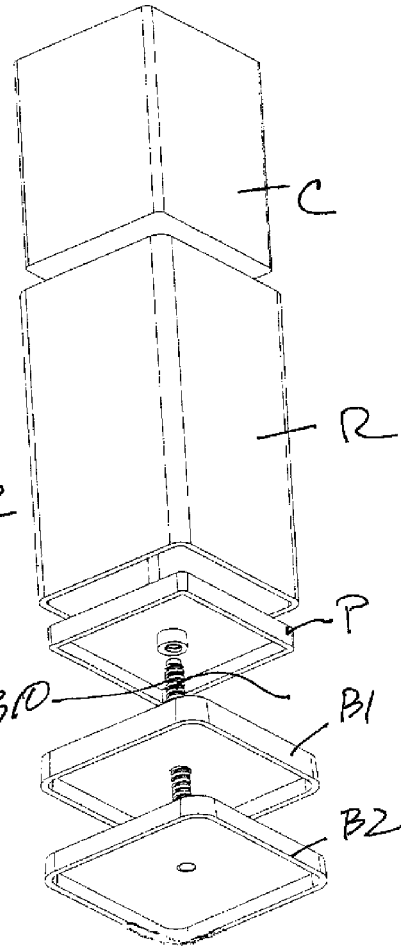
FIG. 7A is an exploded perspective view of the embodiment of my candleholder shown in FIG. 7 looking at the underside of the candleholder.

FIGS. 7A through 7B

My candleholder 300 are similar to my candleholder 200 and 200*a* in that they both use a base B with a cap member B1 and a foundation member B2 that is twisted or rotated to advance the platform P inward towards the open mouth M of the receptacle R. An axle 310 attached to the foundation member B2 extends along the centerline X through the cap member B1 so its tip touches the underside of the platform P. Rotation of the foundation member B2 causes the axle 310 turn and move the platform towards the open mouth M.

FIGS. 8 through 8B

In this embodiment a lighting device 400 is adapted to be used as a lid to cover an open mouth M of a candle receptacle R having a rim 410 with a predetermined configuration and dimensions forming the open mouth M. The lighting device 400 comprises a body member 412 including a light-transmitting window 414 and a battery-energized light 416 within the body member. The body member 412 has opposed sides 412*a* and 412*b*, at least one side including an insert element 418 projecting outward from an adjacent ceiling member 420 on the body member. The ceiling member 420 has dimensions greater than the insert element 418 and the insert element 418 has a perimeter with substantially the same configuration and the same dimensions as the open mouth. It this embodiment the insert element 418 is circular and has a diameter essentially equal to the diameter of the rim 410. A button switch 422 turns the light on and off and may be centrally located or offset to along an edge. The switch 422 is flat so the side 412*a* is leveled and this side 412*a* of the device 400 can rest on a flat horizontal surface upon removal from the receptacle R. The insert element's center is along the candleholder's centerline X and is coextensive with a centerline of the receptacle R on covering the open mouth M with the lighting device 400. Consequently, upon covering the open mouth M with the lighting device 400, the insert element 418 is inserted into the open mouth and is in registration therewith. The user pushes the lighting device 400 inward until the ceiling member 400 adjacent the insert element abuts the rim 410 of the open mouth M.

SCOPE OF THE INVENTION

The above presents a description of the best mode I contemplate of carrying out my candleholder and method, and of the manner and process of making and using them, in such full, clear, concise, and exact terms as to enable any person skilled in the art to which they pertain to make and use my candleholder and method. My candleholder and method are, however, susceptible to modifications and alternate constructions from the illustrative embodiments discussed above which are fully equivalent. Consequently, it is not the intention to limit my candleholder and method to the particular embodiments disclosed. On the contrary, my intention is to cover all modifications and alternate constructions coming within the spirit and scope of my candleholder and method as generally expressed by the following claims, which particularly point out and distinctly claim the subject matter of my invention.

The invention claimed is:

1. A candleholder including a base having a top and a bottom, a hollow candle receptacle on the top of the base, and a moveable platform, said base, receptacle and platform aligned so that said base, when its bottom is placed to rest on a substantially horizontal surface, a candle within the receptacle is in an upright substantially vertical orientation, said candle receptacle having an open mouth as an entryway to an interior of the receptacle, said platform mounted to be manually moved to advance the platform towards the open mouth of the receptacle, a cover member removably seated in the open mouth when the candleholder is oriented vertically, said cover member including a battery-energized light therein enclosed within a light transmitting housing, the cover member has opposed sides, one side facing inward towards the open mouth when the cover member is seated in the open mouth, said one side including the light transmitting housing so, when the cover member is placed to rest on a substantially horizontal supporting surface with the other side facing the horizontal supporting surface, the cover member is inverted so the light transmitting housing is exposed to the view of an observer.

2. A candleholder including a candle receptacle having a sidewall enclosing a hollow receptacle interior with a smooth interior surface and open mouth, said hollow interior holding therein a candle having a body portion that substantially fills the hollow receptacle interior and has an outer end at or nearby the open mouth of the receptacle, an inner end of the candle at or nearby a base end of the receptacle, and an exterior sidewall surface in contact the smooth interior receptacle surface, said candle body portion being moveable within the receptacle in response to the application of pressure against the inner end of the candle to advance the outer end of the candle towards the open mouth of the candle receptacle, the smooth contacting surfaces of the receptacle and the candle sliding past each other, a plunger member at the inner end of the candle and mounted to move inward and push the candle towards the open mouth, and means for manually advancing the plunger member inward, where the advancing means comprises a key member detachably attached to a cover member that removably fits over the open mouth of the receptacle, said key member when detached being manually inserted through a key hole to engage the plunger member and advance said plunger member by manually manipulating the key member.

3. The combination comprising a candle having a body with an inner end and an outer end, said inner and outer ends connected by a smooth exterior surface and said body having a predetermined original height, a predetermined cross-sectional configuration, and predetermined dimensions, and a candleholder including a base, a hollow candle receptacle on the base, and a moveable platform, said candle receptacle having an open mouth as an entryway to a receptacle interior with a predetermined cross-sectional configuration substantially of the same shape and dimensions as said cross-sectional configuration of the candle and a height that is greater than the predetermined original height of the candle, said interior having a smooth surface and said smooth exterior surface of the body of the candle and the smooth interior surface of the receptacle being in contact and sliding past each other as the candle is received within the interior of the receptacle, and with the base resting on a horizontal surface, the candle is within the receptacle in an upright substantially vertical orientation with the inner end of the candle resting on the platform and the outer end of the candle being nearby said open mouth prior to igniting a wick of the candle, so that as the body of the candle is consumed by burning, the outer end of the candle recedes inward and away from the open mouth of the receptacle, reducing the original height of the candle to a reduced height, said platform mounted to be manually moved to advance the platform towards the open mouth of the receptacle after burning the candle to lower the original candle height to the reduced height, said smooth exterior surface of the body of the candle and the smooth interior surface of the receptacle being in contact and sliding past each other as the outer end of the candle is repositioned to nearby said open mouth, said cover member is removably seated in the open mouth when the candleholder is oriented vertically, and said cover member including a battery-energized light therein enclosed within a light transmitting housing, the cover member has opposed sides, one side facing inward towards the open mouth when the cover member is seated in the open mouth, said one side including the light transmitting housing so, when the cover member is placed to rest on a substantially horizontal surface with the other side facing a horizontal supporting surface, the cover member is inverted so the light transmitting housing is exposed to the view of an observer.

4. A candleholder including a base, a hollow candle receptacle on the base, and a moveable platform, said base, receptacle and platform being aligned along a centerline of the candleholder, said base having a bottom that, when placed to rest on a substantially horizontal surface, a candle within the receptacle is in an upright substantially vertical orientation, said candle receptacle having an open mouth as an entryway to an interior of the receptacle, said receptacle interior having a smooth surface, a predetermined cross-sectional configuration that corresponds in shape and dimensions to a candle to be placed in said interior, and a predetermined height that is greater than the maximum original height of said candle, said smooth receptacle interior surface contacting an exterior surface of the candle as said candle is inserted into the interior of the receptacle, an inner end of the candle resting on the platform after inserting the candle, said platform mounted to be manually moved to advance the platform towards the open mouth of the receptacle, said exterior surface of the candle and the smooth interior surface of the receptacle being in contact and sliding past each other as the outer end of the candle is repositioned, a cover member is removably seated in the open mouth when the candleholder is oriented vertically, said cover member including a battery-energized light therein enclosed within a light transmitting housing, the cover member has opposed sides, one side facing inward towards the open mouth when the cover member is seated in the open mouth, said one side including the light transmitting housing so, when the cover member is placed to rest on a substantially horizontal supporting surface with the other side facing the horizontal supporting surface, the cover member is inverted so the light transmitting housing is exposed to the view of an observer.

5. A candleholder including a candle receptacle having a sidewall enclosing a hollow receptacle interior with a smooth interior surface and open mouth, said hollow interior holding therein a candle having a body portion that substantially fills the hollow receptacle interior and has an outer end at or nearby the open mouth of the receptacle, an inner end at or nearby a base end of the receptacle, and an exterior sidewall surface in contact the smooth interior receptacle surface, said candle body portion being moveable within the receptacle in response to the application of pressure against the inner end of the candle to advance the outer end of the candle towards the open mouth of the candle receptacle, the smooth contacting surfaces of the receptacle and the candle sliding past each other, a plunger member at the second end and mounted to move inward and push the candle towards the open mouth, and means for manually advancing the plunger member inward, the advancing means comprises a plurality of cam elements, said cam elements stacked one upon the other with an inner most cam element next to the plunger member, said cam elements mounted to each other to be repositioned relative to each other to vary the height of the stacked cam elements to advance the candle towards the open mouth of the candle receptacle.

6. The candleholder of claim 5 where the receptacle and stacked cam elements are aligned along a centerline of the candleholder.

7. The candleholder of claim 5 where each individual cam element includes a ramp section having a first side with a track therein and a second side with a finger thereon beneath a terminal end of the track, each said finger of one stacked cam element being within the track of another stacked cam element directly beneath said one stacked cam element.

8. The candleholder of claim 5 where the stacked cam elements are free to rotate relative to each other in one direction and said candleholder includes a base comprising a cap member and a foundation member that upon connection of said members provide a housing for the stacked cam elements, with a cam element adjacent the foundation member attached thereto so that rotation of the foundation member in the one direction causes said adjacent cam element to rotate, each cam element being essentially identical in configuration and including at least one ramp section having a first side with a track therein terminating in a stop member at a terminal end of the track and a second side with a finger thereon beneath each terminal end of a track, each said finger of one stacked cam element being within the track of another stacked cam element that is directly beneath said one stacked cam element, so that rotation of the foundation member in said one direction causes the cam element adjacent the foundation member to rotate in said one direction to lift a stacked cam element immediately above said cam element adjacent the foundation as the finger in said lifted cam element rides in the track of the rotating cam element adjacent the foundation member.

9. The candleholder of claim 5 where the receptacle is mounted to a base, said base comprising inner and outer members being detachably connected to provide a housing for the stack of cam elements, said cam elements being initially assembled in a stored position where the stack height is essentially at a minimum and essentially the entire stack is within the base.

10. A candleholder including a base, a candle receptacle on the base and having a hollow interior, and a moveable platform, said base, receptacle and platform being aligned along a centerline of the candleholder, said base having a bottom that, when placed to rest on a substantially horizontal surface, a candle inserted within the interior of the receptacle is in an upright substantially vertical orientation, said hollow interior having an open mouth as an entryway to the interior of the receptacle, said receptacle interior having a smooth surface, a predetermined cross-sectional configuration that corresponds in shape and dimensions to a candle to be placed in said interior, and a predetermined height that is greater than the maximum original height of said candle, said smooth receptacle interior surface contacting an exterior surface of the candle as said candle is inserted into the interior of the receptacle, an inner end of the candle resting on the platform, said platform mounted to be manually moved to advance the platform towards the open mouth of the receptacle, said exterior surface of the candle and the smooth interior surface of the receptacle being in contact and sliding past each other as the outer end of the candle is repositioned, a plurality of cam elements stacked one upon the other and aligned along said centerline, with an inner most cam element next to the plunger member, said cam elements mounted to be repositioned relative to each other to vary the height of the stacked cam elements to increase the pressure against the inner end of the candle and advance the candle towards the open mouth of the receptacle, said base comprising inner and outer members detachably connected to provide a housing for the stack of cam elements, said cam elements being initially assembled in a stored position where the stack height is essentially at a minimum and is substantially enclosed within the base, said plunger member moving into the interior of the receptacle as the cam elements are periodically manually repositioned to press said plunger member against the inner end of the candle and advance the candle inwardly.

11. A candleholder including a candle receptacle having opposed first and second open ends connected by a sidewall, said sidewall enclosing a hollow receptacle interior with a smooth surface, said hollow interior holding therein a candle having a body portion that substantially fills the hollow receptacle interior except for a vacant portion nearby the first open end, said candle having an outer end at or nearby the first open end of the receptacle, an inner end at or nearby the second open end of the receptacle, and an exterior sidewall surface initially in contact with substantially the entire smooth interior receptacle surface, said outer end receding from the first open end as the candle burns to reduce the area of contact between said surfaces, said candle body portion being moveable within the receptacle in response to the application of pressure against the inner end of the candle to advance the outer end of the candle towards the first end of the candle receptacle, the smooth contacting surfaces of the receptacle and the candle sliding past each other, a plunger member at the second end and mounted to bear against the inner end of the candle and to push the candle in a linear direction towards the first end in response to the application of pressure to the inner end as the plunger member advances in said linear direction, a base including at least one hand actuated member that is mounted to be manually rotated and is operably connected to the plunger member to advance the plunger member in said linear direction into the interior and for the plunger member to apply pressure against the inner end of the candle and advance the candle towards the first end of the candle receptacle, and a cover member carried in the open mouth that includes a battery-energized light enclosed within a light-transmitting container, where the cover member is moveable between a first position seated within the first end to direct illumination from the battery-energized light inward into the interior of the receptacle and an inverted second position seated within the first end to direct illumination from the battery-energized light outward away from the interior of the receptacle.

12. A candleholder including a candle receptacle having opposed first and second open ends connected by a sidewall, said sidewall enclosing a hollow receptacle interior with a smooth surface, said hollow interior holding therein a candle having a body portion that substantially fills the hollow receptacle interior except for a vacant portion nearby the first open end, said candle having an outer end at or nearby the first open end of the receptacle, an inner end at or nearby the second open end of the receptacle, and an exterior sidewall surface initially in contact with substantially the entire smooth interior receptacle surface, said outer end receding from the first open end as the candle burns to reduce the area of contact between said surfaces, said candle body portion being moveable within the receptacle in response to the application of pressure against the inner end of the candle to advance the outer end of the candle towards the first end of the candle receptacle, the smooth contacting surfaces of the receptacle and the candle sliding past each other, a plunger member at the second end and mounted to bear against the inner end of the candle and to push the candle in a linear direction towards the first end in response to the application of pressure to the inner end as the plunger member advances in said linear direction, a base including at least one hand actuated member that is mounted to be manually rotated and is operably connected to the plunger member to advance the plunger member in said linear direction into the interior and for the plunger member to apply pressure against the inner end of the candle and advance the candle towards the first end of the candle receptacle, and a cover member carried in the open mouth that includes a battery-energized light enclosed within a light-transmitting container, where the cover member has a leveled side that facilitates resting said cover member on a horizontal surface upon removal from the first end by placing said side in contact with the horizontal surface.

* * * * *